United States Patent [19]

Takai

[11] Patent Number: 4,850,811

[45] Date of Patent: Jul. 25, 1989

[54] COMPRESSOR WITH VARIABLE DISPLACEMENT MECHANISM

[75] Inventor: Kazuhiko Takai, Maebashi, Japan

[73] Assignee: Sanden Corporation, Gunma, Japan

[21] Appl. No.: 224,698

[22] Filed: Jul. 27, 1988

[30] Foreign Application Priority Data

Jul. 28, 1987 [JP] Japan ..... 62-186746

[51] Int. Cl.[4] ..... F04B 1/26

[52] U.S. Cl. ..... 417/222; 417/270

[58] Field of Search ..... 417/222 S, 270

[56] References Cited

U.S. PATENT DOCUMENTS 4,174,191 10/1979 Roberts ..... 417/222
4,175,915 11/1979 Black ..... 417/222
4,664,604 5/1987 Terauchi ..... 417/222 S

FOREIGN PATENT DOCUMENTS 219283 4/1987 European Pat. Off. ..... 417/222 S
261681 11/1986 Japan .
194371 3/1987 Japan ..... 417/269

*Primary Examiner*—William L. Freeh

*Attorney, Agent, or Firm*—Banner, Birch, McKie & Beckett

[57] ABSTRACT

A refrigerant compressor including a compressor housing having a cylinder block is disclosed. A plurality of cylinders are formed around the periphery of the cylinder block. A piston is slidably fitted within each of the cylinders and is reciprocated by a drive mechanism. A crank chamber is formed between the cylinder block and a front end plate of the compressor housing. The drive mechanism includes a drive shaft, a rotor disposed on the drive shaft, a slant plate with an adjustable slant angle disposed adjacent the rotor and a wobble plate disposed adjacent the slant plate. The drive shaft is rotatably supported within the front end plate. Rotation of the drive shaft causes rotation of the rotor and the slant plate, causing nutational motion of the wobble plate to reciprocate the pistons within their cylinders. The compressor housing includes a rear end plate defining suction and discharge. A communicating path communicates between the crank chamber and the suction chamber. A stroke of pistons is changed by adjusting a slant angle of the slant plate. An elastic member urges the slant plate toward minimum slant angle to adjust the slant angle of the slant plate.

4 Claims, 3 Drawing Sheets

COMPRESSOR WITH VARIABLE DISPLACEMENT MECHANISM

BACKGROUND OF THE INVENTION

1. Field Of The Invention

The present invention relates to a refrigerant compressor, and more particularly, to a wobble plate type compressor with a variable displacement mechanism suitable for use in an automotive air conditioning system.

2. Description Of The Prior Art

It has been recognized that it is desirable to provide a wobble plate type piston compressor with a displacement or capacity adjusting mechanism to control compression ratio in response to demand. In a wobble plate type piston compressor, control of the compression ratio can be accomplished by changing the slant angle of a sloping surface of the slant plate in response to an operation of a valve control mechanism as disclosed in U.S. Pat. No. 4,428,718.

However, the compressor and valve control mechanism disclosed in the U.S. Pat. No. 4,428,718, as well as those generally known in the prior art, are complicated in construction and difficult and costly to manufacture. The complicated nature of such compressors and their associated control mechanisms are prone to high maintenance costs. Thus, reliability is a considerable concern.

SUMMARY OF THE INVENTION

It is a primary object of this invention to provide a wobble plate compressor in which the adjustable slant angle of a sloping surface of the slant plate can be changed by a simple structure.

A refrigerant compressor according to the present invention includes a compressor housing having a cylinder block. The cylinder block is provided with a plurality of cylinders and a crank chamber therein. A piston is slidably fitted within each of the cylinders and is reciprocated by a drive mechanism. The drive mechanism includes a wobble plate, a rotor and a drive shaft. The drive shaft is connected to the rotor to drive the rotor. An adjustable slant plate with a sloping surface is connected to the rotor at an adjustable slant angle in close proximity to the wobble plate. A front end plate is disposed on the compressor housing. The compressor housing includes a bearing for rotatably supporting the drive shaft. A rear end plate is disposed on the opposite end of the compressor housing through a valve plate and defines suction and discharge chambers. A communicating path communicates between the crank chamber and the suction chamber. The stroke of the pistons within each cylinder is changed by adjusting the slant angle of the adjustable slant plate. An elastic element urges the slant plate toward a minimum slant angle to adjust the slant angle of the slant plate.

DETAILED DESCRIPTION OF THE PREFERRED EMBODIMENT

Figure 1:
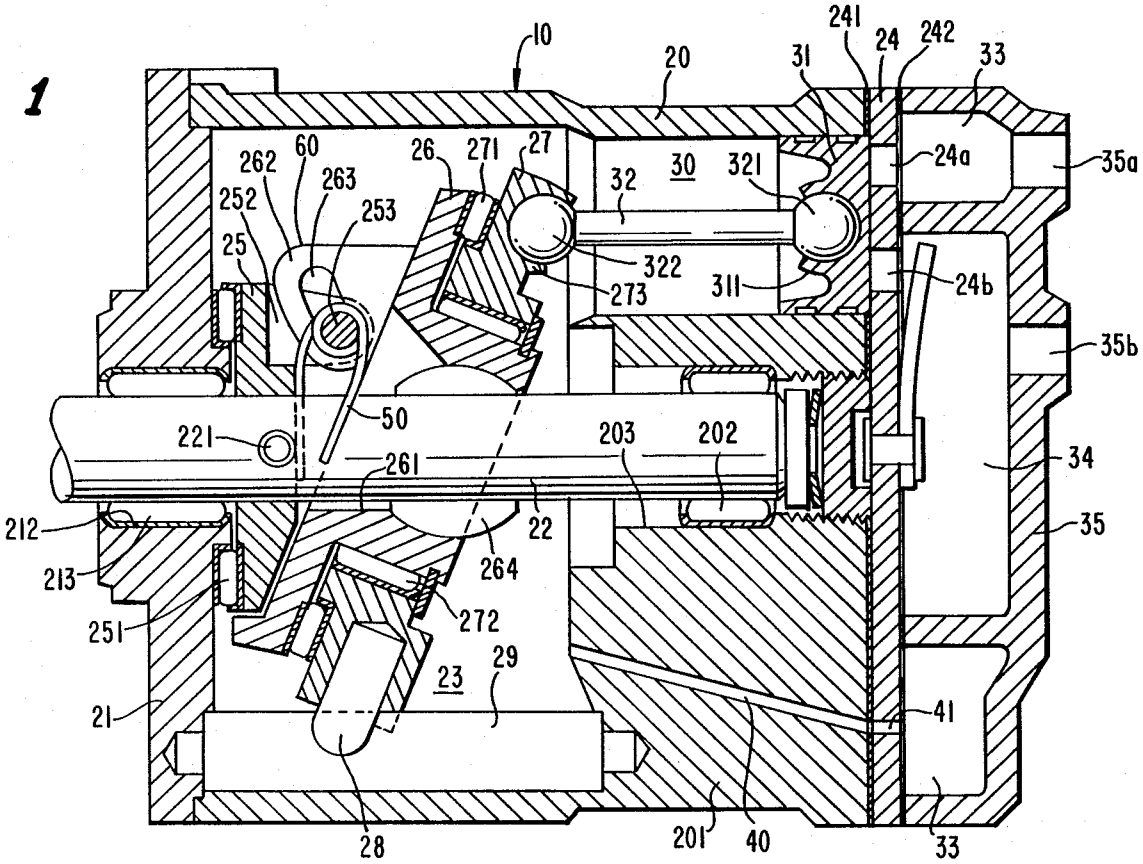
FIG. 1 is a vertical cross-sectional view of a refrigerant compressor according to one embodiment of the present invention.

Referring to FIG. 1, a refrigerant compressor 10 in accordance with one embodiment of the present invention is shown. Compressor 10 includes a closed cylindrical housing assembly 20 formed by a cylinder block 201, a crank chamber 23 within cylinder block 201, a front end plate 21 and a rear plate 35.

Front end plate 21 is mounted on the left end portion of crank chamber 23, as shown in FIG. 1, by a plurality of bolts (not shown). Rear end plate 35 and valve plate 24 are mounted on cylinder block 201 by a plurality of bolts (not shown). An opening 212 is formed in front end plate 21 for receiving a drive shaft 22 which is rotatably supported by front end plate 21 through a bearing 213 which is disposed within opening 212. An inner end portion of drive shaft 22 is also rotatably supported by cylinder block 201 through bearing 202 which is disposed within a central bore 203. Central bore 203 is a cavity formed in a center portion of cylinder block 201. A thrust needle bearing 251 is disposed between an inner end surface of front end plate 21 and an adjacent axial end surface of a cam rotor 25.

Cam rotor 25 is fixed on drive shaft 22 by a pin member 221 which penetrates cam rotor 25 and drive shaft 22. Cam rotor 25 is provided with an arm 252 having a pin 253. A slant plate 26 has an opening 261 formed at a center portion thereof. A spherical bushing 264, slidably mounted on drive shaft 22, is slidably disposed within an inner surface of opening 261 which is spherically concave in shape. Slant plate 26 includes an arm 262 having a slot 263 in which pin 253 is inserted. Cam rotor 25 and slant plate 26 are joined by a hinged joint 60 of pin 253 and slot 263. Pin 253 is able to slide within slot 263 so that the angular position of slant plate 26 can be changed with respect to the longitudinal axis of drive shaft 22 by moving slant plate 26 along drive shaft 22.

A wobble plate 27 is rotatably mounted on slant plate 26 through bearings 271 and 272. The rotation of wobble plate 27 is prevented by a fork-shaped slider 28 which is attached to the outer peripheral end of wobble plate 27 and is slidably mounted on sliding rail 29 held between front end plate 21 and cylinder block 201. In order to slide slider 28 on sliding rail 29, wobble plate 27 wobbles in a non-rotating manner in spite of the rotation of cam rotor 25.

Cylinder block 201 has a plurality of annularly arranged cylinders 30 in which respective pistons 31 slide. All pistons 31 are connected to wobble plate 27 by a corresponding plurality of connecting rods 32. A ball 321 at one end of rod 32 is received in a socket 311 of pistons 31, and a ball 322 at the other end of rod 32 is received in a socket 273 of wobble plate 27. It should be understood that, although only one such ball socket connection is shown in the drawings, there are a plurality of sockets arranged peripherally around wobble plate 27 to receive the balls of various rods 32, and that each piston 31 is formed with a socket for receiving the other ball of rods 32.

Rear end plate 35 is shaped to define a suction chamber 33 and a discharge chamber 34. Valve plate 24, which is fastened to the end of cylinder block 201 by a plurality of screws (not shown) together with rear end plate 35, is provided with a plurality of valved suction ports 24*a* connected between suction chamber 33 and respective cylinders 30, and a plurality of valved discharge ports 24*b* connected between discharge chamber 34 and respective cylinders 30. Suitable reed valves for suction ports 24*a* and discharge ports 24*b* are described in U.S. Pat. No. 4,011,029 issued to Shimizu. Gaskets 241 and 242 are placed between cylinder block 201 and the inner surface of valve plate 24, and the outer surface of valve plate 24 and rear end plate 35, to seal mating surfaces of cylinder block 201, valve plate 24 and rear end plate 35. Suction inlet port 35*a* and discharge outlet port 35*b* are formed at rear end plate 35 and connect to an external fluid circuit, respectively.

A conduit 40 always communicates between crank chamber 23 and suction chamber 33 via a hole 41 which is formed at valve plate 24 which is in turn formed at cylinder block 201.

A twist coil spring 50 is disposed between cam rotor 25 and slant plate 26 and winds around pin 253. One end of twist coil spring 50 contacts one end surface of slant plate 26 and another end of twist coil spring 50 contacts one end surface of cam rotor 25 facing one end surface of slant plate 26.

In operation of refrigerant compressor 10, drive shaft 22 is rotated by an external power source, for example the engine of an automobile, through a rotation transmitting device such as an electromagnetic clutch (not shown). Cam rotor 25 and slant plate 26 joined by the hinged joint are rotated together with drive shaft 22 to cause a non-rotating wobbling motion of wobble plate 27. Rotating motion of wobble plate 27 is prevented by fork-shaped slider 28 which is attached to the outer peripheral end of wobble plate 27 and is slidably mounted on sliding rail 29 held between front end plate 21 and cylinder block 201. As wobble plate 27 moves, pistons 31 reciprocate out of phase in their respective cylinders 30. Upon reciprocation of pistons 31, the refrigerant gas, which is introduced into suction chamber 33 from the external fluid circuit through suction inlet port 35*a* is taken into each cylinder 30 through suction port 24*a* and compressed. The compressed refrigerant gas is discharged to discharge chamber 34 from each cylinder 30 through discharge port 24*b*, and therefrom into the external fluid circuit through a discharge outlet port 35*b*.

Figure 2:
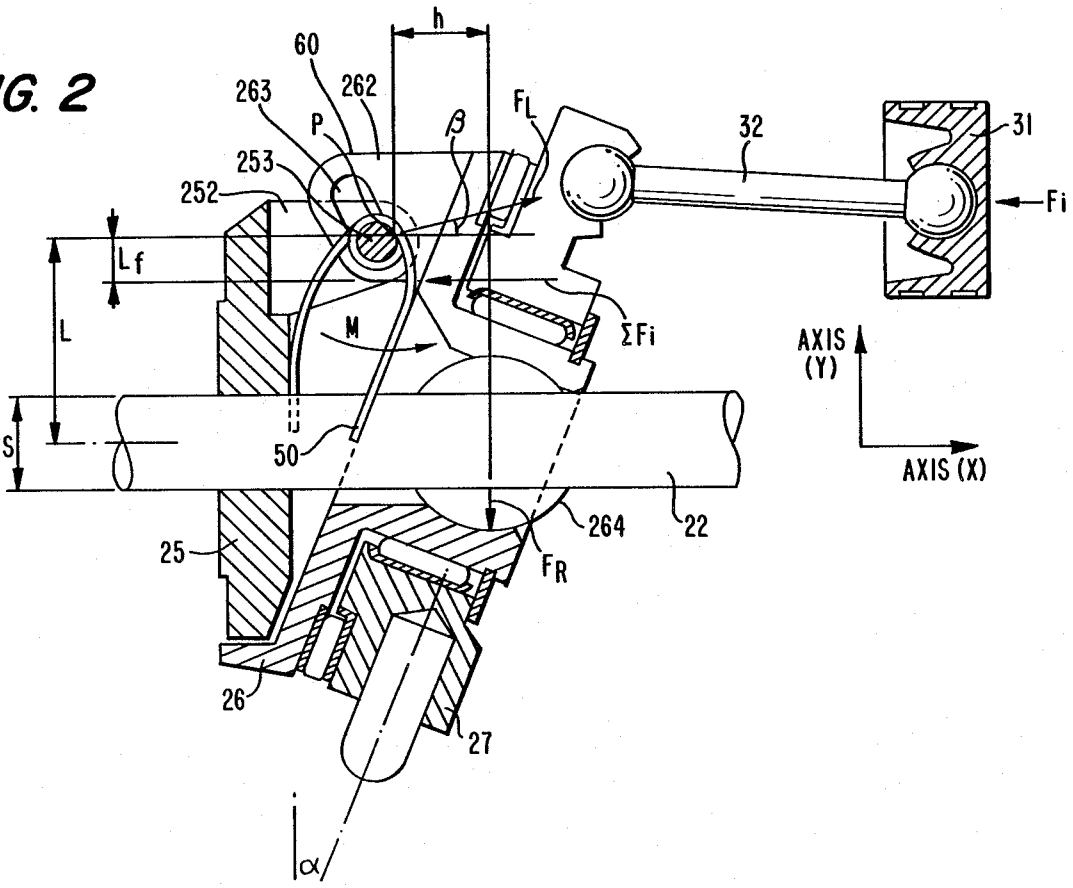
FIG. 2 is a partial cross-sectional view illustrating the moment of forces which act on the slant plate of the compressor shown in FIG. 1.

Referring to FIG. 2, an adjusting mechanism for the slant angle of slant plate 27 will be explained as follows. In a compressing stroke, a force (Fi) pressing each piston 31 occurs as shown in FIG. 2. (Fi) is shown as the following equation:

$$Fi = A(P_2 - P_1) \quad ①$$

In equation ①, (A) is a sectional area of piston 31, ($P_1$) is a pressure within crank chamber 23 and ($P_2$) is a pressure within cylinder 30. In addition, force ($\Sigma$Fi), the sum of each (Fi), has the position and direction shown in FIG. 2. With force ($\Sigma$Fi), resistance force ($F_L$) and $F_R$) are created as shown in FIG. 2. The point of action of ($F_L$) is a contact point (P) between pin 253 and an inner wall of slot 263.

Furthermore, the approximate equation of the moment of force relating to contact point (P) is shown as follows:

$$\Sigma Fi \times L_f + F_R \times h = \mp \mu F_R \times (L + Ds/2) + M \quad ②$$

In equation ②, ($\mu$) is the friction coefficient between drive shaft 22 and spherical bushing 264, (h) is the distance from point (P) to ($F_R$) in relation to (X) axis (the longitudinal axis of drive shaft 22), ($L_f$) is the distance from point (P) to ($\Sigma$Fi) in relation to (Y) axis (being perpendicular to (X) axis), (L) is the distance from point (P) to the longitudinal axis of drive shaft 22, (Ds) is the diameter of drive shaft 22, and (M) is the turning effect or torque caused by the restoring force of twist coil spring 50. The (+) sign placed before ($F_R$) indicates the direction of friction force ($F_R$). The (−) (sign) is used in displacement control during a heat load decreasing stage and the (+) (sign) is used in displacement control during a heat load increasing stage.

Additionally, the relationship between the point of action of ($\Sigma$Fi) and suction pressure is as follows. When suction pressure is high, the point of action of ($\Sigma$Fi) moves toward the longitudinal axis of drive shaft 22 so that distance ($L_f$) increases. Conversely, when suction pressure is low, the point of action of ($\Sigma$Fi) moves away from the longitudinal axis of drive shaft 22 so that distance ($L_f$) decreases. Thus, when the suction pressure is high, term ($\Sigma Fi \times L_f$) of equation ② increases and when the suction pressure is low, term ($\Sigma Fi \times L_f$) of equation ② decreases. In accordance with the increase of term ($\Sigma Fi \times L_f$), term (M) increases to satisfy equation ②. Conversely, in accordance with a decrease of term ($\Sigma Fi \times L_f$), term (M) decreases to satisfy equation ②. Thus, an increase of term (M) indicates an increase of the slant angle of slant plate 26 and a decrease of term (M) indicates a decrease of the slant angle of slant plate 26.

Accordingly, the slant angle of slant plate 26 is adjusted to satisfy the above mentioned equation ②. Namely, the slant angle of slant plate 26 is adjusted to balance the moment forces relating to point (P).

Figure 3:
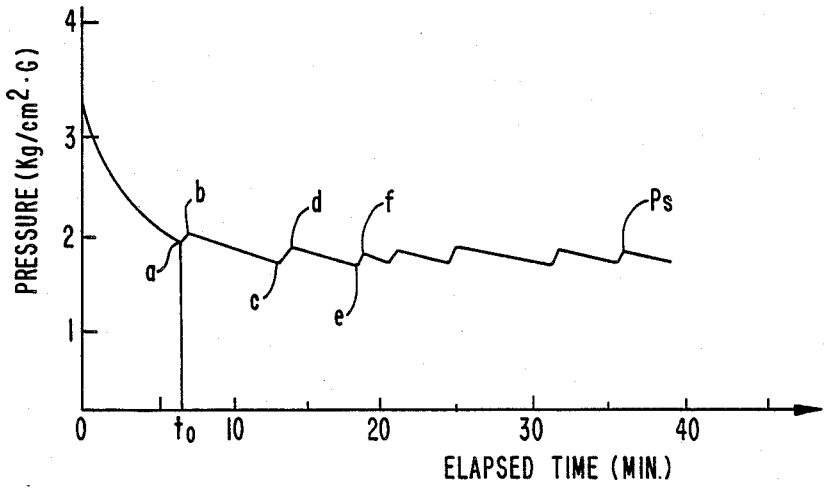
FIG. 3 is a graph showing the change of suction pressure in a pull down stage of the compressor.

Referring to FIG. 3, during the beginning of compressor operation, the suction pressure (Ps) is exceedingly high because the heat load requirement is exceedingly large. When suction pressure (Ps) is exceedingly high, slant plate 26 is at the maximum slant angle by reason of the above mentioned relationships. At the maximum slant angle position, the heat load requirement continues to fall. Consequently, suction pressure (Ps) also continues to fall. When suction pressure (Ps) falls to the point (a) as shown in FIG. 3, namely, at elapsed time (to) the point of action of ($\Sigma$Fi) moves to a position away from the longitudinal axis of drive shaft 22 and stays at such position to satisfy equation ②. Accordingly, the slant angle of slant plate 26 decreases so that the capacity displacement is reduced. At this time, suction pressure (Ps) suddenly rises by a small amount to point (b) due to reduced capacity displacement. However, the reduced capacity displacement is sufficient for the heat load requirements and suction pressure (Ps) begins to slowly fall from point (b). When suction pressure (Ps) falls to point (c), the point of action of ($\Sigma$Fi) moves further away from the longitudinal axis of drive shaft 22 and stays at such position to satisfy equation (2). Accordingly, the slant angle of slant plate 26 further decreases so that the capacity displacement is further reduced. Suction pressure (Ps) then suddenly rises by a small amount to point (d) due to the reduced capacity displacement. This reduced capacity displacement is also sufficient for the heat load requirements and suction pressure (Ps) continues to slowly fall from point (d). When suction pressure (Ps) falls to the point (e), point of action of ($\Sigma Fi$) moves further away from the longitudinal axis of drive shaft 22 and stays at such position to satisfy equation ②. Accordingly, the slant angle of slant plate 26 further decreases so that the capacity displacement is further reduced. At this time, suction pressure (Ps) suddenly rises again by a small amount to point (f) because of reduced capacity displacement. However, this reduced capacity displacement is also sufficient for the heat load requirements and suction pressure (Ps) begins to slowly fall again from point (f). Thus, the above process is repeated in order to keep suction pressure constant, namely, to keep a room temperature constant.

Figure 4:
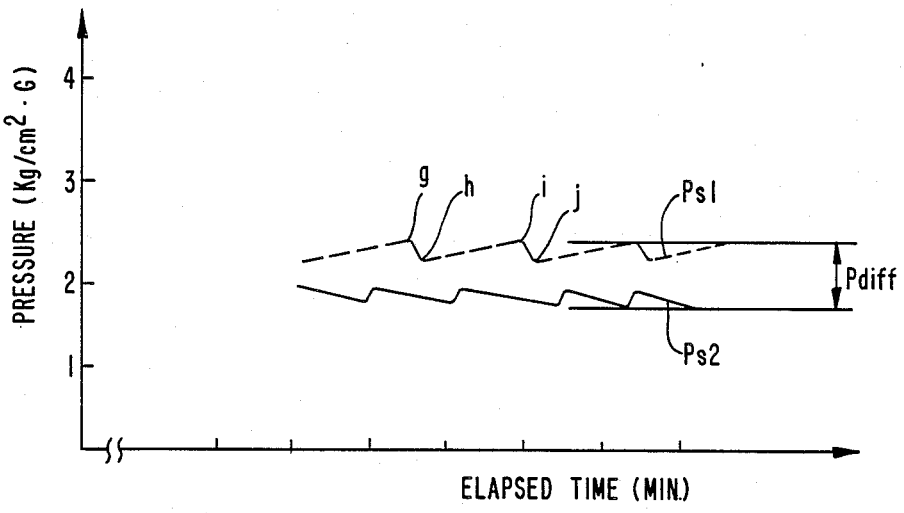
FIG. 4 is a graph showing the change of suction pressure in a regular control stage of capacity displacement. The dashed line represents the capacity displacement control during a heat load increasing stage and the solid line represents the capacity displacement control during a heat load decreasing stage.

Referring to FIG. 4, a regular control stage of capacity displacement is shown. The regular control stage of capacity displacment has two stages. One stage is a capacity displacement control during a heat load decreasing stage as shown by a solid line. The other stage is a capacity displacement control during a heat load increasing stage as shown by a dashed line. The manner of suction pressure changing of the displacement control during the heat load decreasing stage is substantially similar to the stage from the point (a) to the point (f) shown in FIG. 3 as discussed above. The manner of suction pressure changing of the displacement control on the heat load increasing stage is as follows. In the displacement control during the heat load increasing stage, a suction pressure (Ps1) rises slowly to the point (g) because the reduced capacity displacement is not sufficient for the heat load requirements. When suction pressure (Ps1) reaches point (g), the point of action of ($\Sigma Fi$) moves to toward the longitudinal axis of drive shaft 22 and stays at such position to satisfy equation②. Accordingly, the slant angle of slant plate 26 increases so that the capacity displacement is increased. At this time, suction pressure (Ps1) suddenly falls by a small amount to point (h), because of the increased capacity displacement. However, this increased capacity displacement is not sufficient for the heat load requirements and suction pressure (Ps1) begins to slowly rise from point (h). When suction pressure (Ps1) rises to point (i), the point of action of ($\Sigma Fi$) moves further toward the longitudinal axis of drive shaft 22 and stays at such position to satisfy equation (2). Accordingly, the slant angle of slant plate 26 further increases so that the capacity displacement is further increased. Suction pressure (Ps1) suddenly falls by a small amount again to point (j) because of the increased capacity displacement. However, this reduced capacity displacement is not sufficient for the heat load requirements. Thus suction pressure (Ps1) begins to slowly rise again from point (j). The above mentioned process manner is repeated in order to keep suction pressure constant, namely, to keep a room temperature constant.

During a regular control stage of capacity displacement, there exists pressure difference (Pdiff) exists between a suction pressure (Ps1) which is maintained constant during the displacement control in the heat load increasing stage and a suction pressure (Ps2) which is maintained constant during the displacement control in the heat load decreasing stage. This pressure difference (Pdiff) is due to the hysteresis caused by the friction between drive shaft 22 and spherical bushing 264. This friction is indicated by term ($\mp\mu F_R$) of equation②. The amount of the hysteresis is mainly a function of ($\mu$) shown in equation②and the location of hinged joint 60. Therefore, pressure difference (Pdiff) can be eliminated or disregarded by properly choosing ($\mu$) and properly locating hinged joint 60 when the compressor is designed.

Furthermore, the value of the suction pressure in the regular control stage of capacity control and the sensitivity of capacity control are also determined by properly choosing the value of each figure is equation② when the compressor is designed.

This invention has been described in detail in connection with a preferred embodiment. This embodiment, however, is merely for example only and the invention is not restricted thereto. It will be easily understood by those skilled in the art that other variations and modifications can easily be made within the scope of this invention, as defined by the appended claims.

What is claimed is:

1. In a refrigerant compressor including a compressor housing having a cylinder block provided with a plurality of cylinders and a crank chamber within said cylinder block, a piston slidably fitted within each of said cylinders and reciprocated by a drive mechanism including a wobble plate, a rotor and a drive shaft connected to said rotor to drive said rotor, an adjustable slant plate with a sloping surface being connected to said rotor at an adjustable slant angle in close proximity to said wobble plate, a front end plate disposed on said compressor housing including a bearing for rotatably supporting said drive shaft, a rear end plate disposed on an opposite end of said compressor housing through a valve plate defining a suction chamber and a discharge chamber, a communicating path communicating from said crank chamber to said suction chamber, a stroke of said pistons within said cylinders being able to be changed by adjusting a slant angle of said adjustable slant plate, the improvement comprising:

a means for elastically urging said adjustable slant plate toward a minimum slant angle to adjust said slant angle of said adjustable slant plate;

a restoring force of said elastic means keeps balancing with moment which urges said adjustable slant plate toward a maximum slant angle;

said rotor and said adjustable slant plate are connected by a hinged joint comprising a pin and a slot;

said elastic means is a twist coil spring disposed between said rotor and said adjustable slant plate with winding around said pin of said rotor.

2. The refrigerant compressor of claim 1 wherein said twist coil spring further exhibits a spring constant M capable of balancing moment forces relating to the hinged joint.

3. In a refrigerant compressor including a compressor housing having a cylinder block provided with a plurality of cylinders and a crank chamber within said cylinder block, a piston slidably fitted within each of said cylinders and reciprocated by a drive mechanism including a wobble plate, a rotor and a drive shaft connected to said rotor to drive said rotor, an adjustable slant plate with a sloping surface being connected to said rotor at an adjustable slant angle in close proximity to said wobble plate, a front end plate disposed on said compressor housing including a bearing for rotatably supporting said drive shaft, a rear end plate disposed on an opposite end of said compressor housing through a valve plate defining a suction chamber and a discharge chamber, a communicating path communicating from said crank chamber to said suction chamber, a stroke of said pistons within said cylinders being able to be changed by adjusting a slant angle of said adjustable slant plate, the improvement comprising:

a means for elastically urging said adjustable slant plate toward a minimum slant angle to adjust said slant angle of said adjustable slant plate;

a restoring force of said elastic means keeps balancing with moment which urges said adjustable slant plate toward a maximum slant angle;

said rotor and said adjustable slant plate are connected by a hinge; and said elastic means is a twist coil spring disposed between said rotor and said adjustable slant plate with winding around said pin of said rotor.

4. The refrigerant compressor of claim 3 wherein said twist coil spring further exhibits a spring constant M capable of balancing moment forces relating to the hinged joint.

* * * * *